US008096634B2

(12) United States Patent
Wiggins

(10) Patent No.: US 8,096,634 B2
(45) Date of Patent: Jan. 17, 2012

(54) TEMPERATURE COMPENSATION FOR FULL-WIDTH ARRAYS WRITE HEADS

(75) Inventor: Douglas Wiggins, Ontairo, NY (US)

(73) Assignee: Xerox Corporation, Norwalk, CT (US)

( * ) Notice: Subject to any disclaimer, the term of this patent is extended or adjusted under 35 U.S.C. 154(b) by 967 days.

(21) Appl. No.: 11/856,456

(22) Filed: Sep. 17, 2007

(65) Prior Publication Data

US 2009/0073252 A1 Mar. 19, 2009

(51) Int. Cl.
*B41J 29/38* (2006.01)

(52) U.S. Cl. ..... 347/17; 347/19; 347/130; 347/133; 347/238

(58) Field of Classification Search ..... None
See application file for complete search history.

(56) References Cited

U.S. PATENT DOCUMENTS

| | | | | |
|---|---|---|---|---|
| 4,536,778 | A * | 8/1985 | De Schamphelaere et al. | 347/130 |
| 5,057,854 | A | 10/1991 | Pond et al. | |
| 5,119,206 | A | 6/1992 | Rourke et al. | |
| 5,160,945 | A | 11/1992 | Drake | |
| 5,528,272 | A | 6/1996 | Quinn et al. | |
| 5,587,730 | A | 12/1996 | Karz | |
| 5,936,657 | A * | 8/1999 | Fork | 347/237 |
| 6,808,249 | B1 | 10/2004 | Kneezel et al. | |
| 2005/0062838 | A1 * | 3/2005 | Kudou | 347/238 |

FOREIGN PATENT DOCUMENTS

| | | | | |
|---|---|---|---|---|
| JP | 03219973 | A * | 9/1991 | 347/237 |

* cited by examiner

*Primary Examiner* — Uyen Chau N Le
*Assistant Examiner* — Chad Smith
(74) *Attorney, Agent, or Firm* — MH2 Technology Law Group LLP

(57) ABSTRACT

A method and system for compensating for temperature changes is disclosed that includes a mounting bar, a plurality of imaging chips adaptively mounted on the mounting bar, each imaging chip including a plurality of imaging elements, and a temperature determiner to determine a temperature of the mounting bar. A control module enables and disables at least one imaging element based on the determined temperature of the mounting bar.

19 Claims, 4 Drawing Sheets

300

320

IMAGING ELEMENT

| TEMPERATURE | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 90 | 1 | 1 | 0 | 1 | 1 | 1 | 1 | 1 | 0 | 1 | 1 | 1 | 1 | 1 | 0 | 1 | 1 | 1 | 1 | 1 |
| 100 | 1 | 1 | 0 | 1 | 1 | 1 | 1 | 1 | 0 | 1 | 1 | 1 | 1 | 1 | 0 | 1 | 1 | 1 | 1 | 1 |
| 110 | 1 | 1 | 0 | 1 | 1 | 1 | 1 | 1 | 0 | 1 | 1 | 1 | 1 | 1 | 0 | 1 | 1 | 1 | 1 | 1 |
| 120 | 1 | 1 | 0 | 1 | 1 | 1 | 1 | 1 | 0 | 1 | 1 | 1 | 1 | 1 | 0 | 1 | 1 | 1 | 1 | 1 |
| 130 | 1 | 0 | 1 | 1 | 1 | 1 | 1 | 0 | 1 | 1 | 1 | 1 | 1 | 0 | 1 | 1 | 1 | 1 | 1 | 0 |
| 140 | 0 | 1 | 1 | 1 | 1 | 1 | 0 | 1 | 1 | 1 | 1 | 1 | 0 | 1 | 1 | 1 | 1 | 1 | 0 | 0 |
| 150 | 1 | 1 | 1 | 1 | 1 | 0 | 1 | 1 | 1 | 1 | 1 | 0 | 1 | 1 | 1 | 1 | 1 | 0 | 0 | 0 |

310

FIG. 3

TEMPERATURE COMPENSATION FOR FULL-WIDTH ARRAYS WRITE HEADS

FIELD

The subject matter of the teachings disclosed herein relates to imaging elements. More particularly, the subject matter of the teachings disclosed herein relates to temperature compensation for a full width imaging array that includes the imaging elements.

BACKGROUND

Full width array write heads using various technologies, such as for example, light emitting diodes (LEDs), inkjet, etc. are being widely used in printers. Such full width array write heads provide an economical way to quickly print across an entire width of a page with a high degree of resolution.

Typically the full width writing array is assembled on a mounting bar to provide structural rigidity, mounting capacity and some temperature stability. In the case of the full width writing array relying on LED technology, the same array can be used for cyan, magenta, yellow or black. Unfortunately, each array is subject to different temperature conditions. The array closest to the fuser often requires special treatment using fans or other cooling methods.

FIG. 1A shows a conventional full width array write head assembly 100. In particular, the conventional full width array write head 100 includes a mounting bar 110, a full width array write head 140, and mounting holes 130.

Full width array write head 140 consists of imaging chips 120. The imaging chips 120 can be butted end-to-end and bonded to the mounting bar 110. Alternatively, imaging chips 120 can be disposed in two or more rows, for example, in a staggered configuration. The imaging chip can also be a single chip, for example, an organic light emitting diode (OLED). Each of the imaging chips 120 include a plurality of LEDs, shown in more detail in FIG. 1B. The mounting holes 130 on the ends of the mounting bar 110 are used to mount the full width array write head 100 to a printer (not shown).

The imaging chips 120 are individually activated by printhead circuitry (not shown) to form an image. The image is then transferred to an imaging medium, e.g., paper. Such transfer of an image from an imaging chip 120 to an imaging medium is well known within the art.

FIG. 1B shows a portion of a conventional imaging chip 120.

Printers are typically rated at dots per inch (dpi) resolution. A typical dpi for a printer can be 600 dpi. For example, a LED imaging chip 120 used in a printer that is rated at 600 dpi contains a density of LEDs such that an imaging medium passing one inch across the imaging chip can produce 600 individual dots per inch.

Because of the difficulty in illustrating the face of a conventional imaging chip 120 that has such a large number of LEDs that produce a high resolution, e.g., 600 dpi, FIG. 1B shows an example of a portion of an imaging chip 120 that has 15 LEDs on its face.

As the full width array write head assembly 100 heats up, its length increases due to thermal expansion. A particular source of heat is a fuser, with the area nearest the fuser being heated the most. For example, a 600 dpi system over an 11 inch width might become a 595 dpi system over 11.092437 inches after being heated. Such a loss in resolution and change in magnification is undesirable, Attempts have been made to compensate for thermal stresses and expansion on a full width array write head. One such patent, U.S. Pat. No. 5,528,272 discloses use of a full width array write head that is constructed of materials having a high thermal coefficient of expansion and a low thermal coefficient of expansion. An adhesive for holding various components together provides lateral give while firmly holding the respective components together. The use of an adhesive that provides for lateral give relieves shear stress caused by the expansion and contraction of materials having different coefficients of expansion.

Other attempts to deal with heat issues related to a full width array write head included use of a liquid to cool a metal substrate. Moreover, a dedicated fan has been employed to cool a full width array closest to a fuser. However, whatever attempts have been made to compensate for thermal stresses and expansion on a full width array write head, thermal stresses still exist on a full width array write head that result in changes in resolution and magnification.

Accordingly, the present teachings solve these and other problems of the prior art's compensation for thermal stresses on a full width array write head.

SUMMARY

In accordance with the teachings, a system for compensating for temperature changes is disclosed that includes a mounting bar, a plurality of imaging elements adaptively mounted on the mounting bar, and a temperature determiner to determine a temperature of the mounting bar. A control module can at least one of enable and disable at least one imaging element based on the determined temperature of the mounting bar.

A method of compensating for temperature changes is disclosed that includes providing a mounting bar, providing a plurality of imaging elements on the mounting bar, and determining at least one temperature of the mounting bar. At least one of enabling and disabling at least one imaging element is performed based on the determined temperature of the mounting bar.

Additional advantages of the embodiments will be set forth in part in the description which follows, and in part will be obvious from the description, or may be learned by practice of the teachings. The advantages will be realized and attained by means of the elements and combinations particularly pointed out in the appended claims.

It is to be understood that both the foregoing general description and the following detailed description are exemplary and explanatory only and are not restrictive of the teachings, as claimed.

The accompanying drawings, which are incorporated in and constitute a part of this specification, illustrate embodiments of the teachings and together with the description, serve to explain the principles of the teachings.

BRIEF DESCRIPTION OF THE DRAWINGS

FIG. 3 shows an exemplary lookup table for enabling/disabling imaging elements, in accordance with the principles of the present teachings.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the teachings disclosed herein are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. Moreover, all numerical values are disclosed by way of example and are not intended to be limiting in scope.

According to the teachings disclosed herein a full width array includes additional imaging elements. The additional imagining elements are in addition to a rated resolution for a device employing the full width array. Any of the imaging elements can be selectively enabled and disabled, i.e., enabled/disabled, as a function of a temperature. In this manner, thermal stresses and expansion are compensated for to maintain a consistent rated resolution over a desired print field and magnification for a full width array.

Figure 1A:
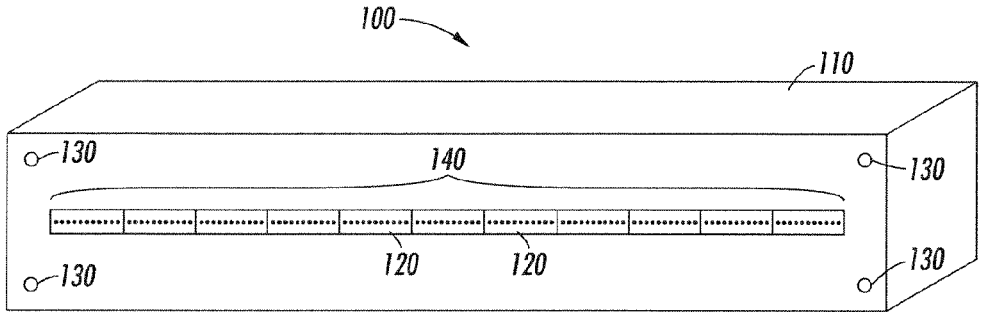
FIG. 1A (Prior Art)
FIG. 1A shows a conventional full width array write head assembly.
Figure 1B:
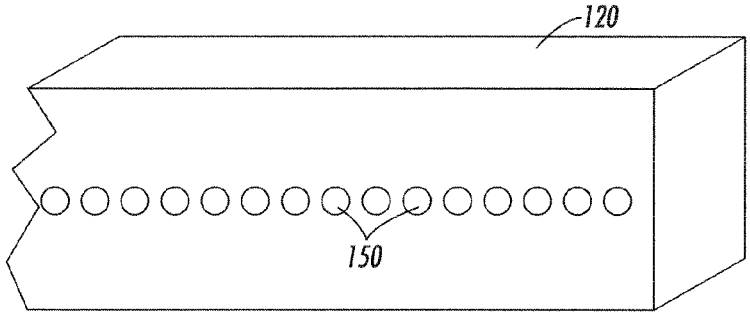
FIG. 1B (Prior Art)
FIG. 1B shows a portion of a conventional imaging chip.
Figure 2A:
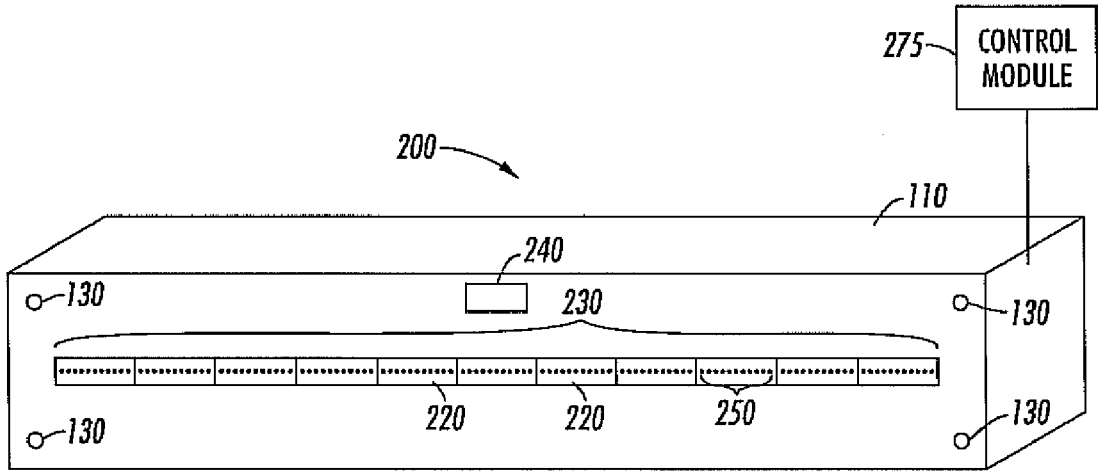
FIG. 2A shows a full width imaging array, in accordance with the principles of the present teachings.

FIG. 2A shows a full width imaging array 200, in accordance with the principles of the present teachings. It should be readily apparent to those of ordinary skill in the art that the full width imaging array 200 shown in FIG. 2A represents a generalized system illustration and that other components can be added or existing components can be removed or modified while still remaining within the spirit and scope of the present teachings.

In particular, the full width imaging array 200 shown in FIG. 2A can include a mounting bar 110, a full width array head 230, mounting holes 130, and a control module 275. In contrast to conventional image chips 120, the full width imaging array 200 disclosed in FIG. 2A can rely on image chips 220. Imaging chips 220 can abut end-to-end and use LED technology to form an image on an imaging medium, e.g., photoreceptor and then developed and transferred to paper. In accordance with the teachings disclosed herein, image chips 220 can include additional imaging elements 250 that are selectively enabled/disabled as a function of a temperature of the mounting bar 110.

The temperature of the mounting bar 110 can be determined through a reading from thermistor 240. In an imaging device employing multiple full width imaging arrays 200, each individual full width imaging array 200 can be constructed to each employ a thermistor 240 to monitor a local temperature for their respective mounting bars 110. For example, a full width imaging array 200 employed nearest a fuser would most likely have the largest temperature fluctuations due to the fuser being a source of heat. However, a full width imaging array 200 farther from a fuser would most likely have lesser temperature fluctuations as compared to a full width imaging array 200 nearest a fuser. Thus, each full width imaging array 200 in an imaging device employing multiple full width imaging arrays 200 can each employ a thermistor 240. Each full width imaging array 200 employing a thermistor 240 can allow individual adjustment of a resolution of a full width imaging array 200 according to a temperature local to a particular full width imaging array 200.

The imaging chips 220 disclosed above can be identical across the full length of the full width array head 230. Within the scope of the teachings disclosed herein the imaging chips 220 can include additional imaging elements 250. The temperature of the mounting bar 110 as determined through thermistor 240 can be used as a factor in determining which imaging elements 250 on which imaging chips 220 to enable/disable. The mounting bar 110 can have a known coefficient of thermal expansion that is a function of its material makeup. Individual imaging elements 250 on imaging chips 220 can be enabled/disabled using the mounting bar's 110 coefficient of thermal expansion and the temperature of the mounting bar 110 as determined through thermistor 240.

Control module 275 can read the values from thermistor 240 to extrapolate a temperature of the mounting bar 110. Control module 275 can determine which imaging elements 250 to enable/disable, as discussed in more detail below. The control module can contain an algorithm that uses temperature to calculate which imaging elements 220 to enable/disable to maintain an even spread of imaging elements 250 throughout a print field. The calculated imaging elements 220 to enable/disable can be stored in a lookup table, as shown in more detail in FIG. 3. The control module 275 and thermistor 240 together form a temperature determiner to determine a temperature of the mounting bar 110.

Figure 2B:
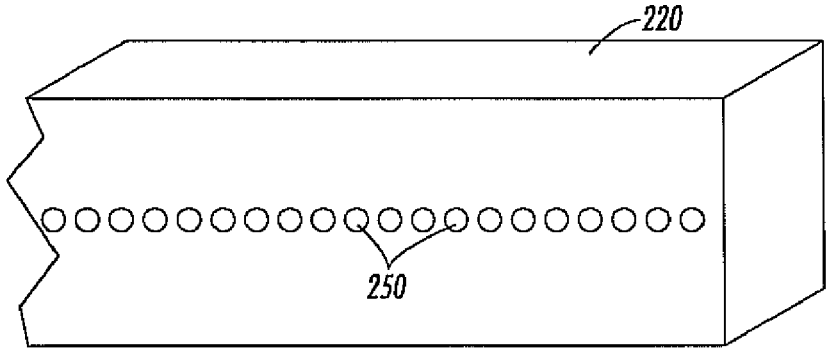
FIG. 2B shows a portion of an imaging chip, in accordance with the principles of the present teachings.

FIG. 2B shows a portion of an imaging chip 220, in accordance with the principles of the present invention. It should be readily apparent to those of ordinary skill in the art that the imaging chip 220 shown in FIG. 2B represents a generalized system illustration and that other components can be added or existing components can be removed or modified while still remaining within the spirit and scope of the present teachings.

Because of the difficulty in illustrating the face of imaging chip 220 that has a large resolution, e.g., a resolution of 620 dpi, FIG. 2B shows an example of a portion of an imaging chip 220 having such a high resolution. The principles of the present teachings apply to any size imaging chip 220 having any number of imaging elements 250. The portion of an imaging chip 220 shown in FIG. 2B is shown by way of example to include twenty LED imaging elements 250 that can produce a resolution of, e.g., 620 dpi. With a size of a portion of an imaging chip 220 being the same as a size of an imaging chip 120, imaging chip 220 includes five additional imaging elements 250. Any of the imaging elements 250 shown in FIG. 2B can be enabled/disabled to maintain a desired resolution, e.g., 600 dpi.

For example, a portion of a resolution, e.g., 20 dpi, from imaging chip 220 can be enabled/disabled to maintain a target resolution, e.g., 600 dpi. The particular LED imaging elements 250 that can be enabled/disabled can be dependent upon a temperature of a mounting bar 110. The particular LED imaging elements 250 that can be enabled/disabled provides an even spread of LED imaging elements 250 along a desired imaging width, e.g., eleven inches, at a variety of temperatures.

In contrast to a conventional imaging chip 120 that relies on all of its imaging elements 250 to produce a resolution of 600 dpi, in accordance to the principles of the present teachings the imaging chip 220 can include additional imaging elements beyond those that the imaging chip 220 is rated for. For example, imaging chip 220 can produce a maximum resolution of 620 dpi. LEDs on imaging chip 220 can be disabled to arrive at a rated dpi for the imaging chip 220. Any of the LEDs on imaging chip 220 can be enabled/disabled to maintain a desired dpi, e.g., to maintain a 600 dpi. The LEDs on the imaging chip 220 can be enabled/disabled as a function of a temperature of the mounting bar 110.

The imaging chip 220 can be used in the same imaging device (not shown) as imaging chip 120. An imaging device, e.g., a printer, can operate with software that can be programmed to coincide with the dpi of the imaging chip 220. For example, an imaging device can be designed to operate at 600 dpi. To use the imaging chip 220 in the same imaging device as is used with imaging chip 120, any imaging elements 250 producing a resolution in excess of 600 dpi, e.g., any of the LEDs producing 620 dpi can be enabled/disabled to arrive at the expected 600 dpi. As a temperature of a mounting bar 110 changes, any of the imaging elements 250 can be enabled/disabled to maintain the expected 600 dpi. Any of the imaging elements 250 can be enabled/disabled to maintain an even spread of active imaging elements 250 along a desired page width, e.g., 11 inches.

Thus, in accordance with the teachings disclosed herein imaging elements 250 on an imaging chip 220 can be selectively enabled/disabled as a function of temperature. The enabling/disabling of the imaging elements 250 can be completely automated to occur within an imaging device, requiring no user input. An imaging device that includes the full width imaging array 200 disclosed herein would appear to a computing device as a conventional imaging device.

FIG. 3 shows an exemplary lookup table 300 for enabling/disabling imaging elements 250, in accordance with the principles of the present teachings. It should be readily apparent to those of ordinary skill in the art that the lookup table 300 shown in FIG. 3 represents a generalized lookup table and that other values can be added or existing values can be removed or modified while still remaining within the spirit and scope of the present teachings.

In particular, lookup table 300 includes rows 310 that can represent temperatures that are typically encountered by a mounting bar 110. Lookup table 300 includes columns 320 that can represent individual imaging elements 250 on an imaging chip 220. A "1" represents that a particular imaging element 250 on an imaging chip 220 that can be enabled or activated. A "0" represents a particular imaging element 250 on an imaging chip 220 can be disabled or deactivated.

Imaging chip 220 shown in FIG. 2B can correspond to the lookup table 300 shown in FIG. 3. Lookup table 300 can include, for exemplary simplification only, twenty rows to correspond to the twenty imaging elements 250 on the imaging chip 220 shown in FIG. 2B. However, lookup table 300 in practice can include an entry for each imaging element 250 on imaging chip 220 that makeup a full width imaging array 200. Such a lookup table 300 can be used to selectively enable/disable any imaging element 250 along the entire length of the full width imaging array 200 to maintain a desired dpi, e.g., 600 dpi, using imaging chips 220 that have a higher resolution, e.g., 620 dpi.

Although the principles disclosed herein apply to any imaging elements 250 along the length of full width imaging array 200, lookup table 300 is exemplarily directed toward imaging elements 250 that are nearest the right end of the full width imaging array 200. Because the length of the full width imaging array 200 increases with temperature, the end imaging elements 250 at the right end of the full width imaging array 200 will get pushed off of a designated print area. FIG. 3 shows that imaging elements 250 are enabled/disabled as a function of temperature. FIG. 3 shows that endmost imaging elements 250 on a full width imaging array 200 are disabled as they are pushed off of a designated print and/or scan field as a function of temperature.

As shown in the lookup table 300, at lower temperatures of a mounting bar 110, e.g., >=90° F. and <130° F., the third, ninth and fifteen imaging elements 250 of an exemplary imaging chip 220 can be disabled while the remaining imaging elements can be enabled.

As mounting bar 110 reaches higher temperatures, e.g., >=130° F., the twentieth imaging element of an exemplary imaging chip 220 can be disabled. The twentieth imaging element is disabled at higher temperatures, e.g., >=130° F., because at such temperatures the twentieth imaging element is pushed off of a designated print field. At >=130° F. and <140° F., the second eight and fourteenth imaging elements the exemplary imaging chip 220 can be disabled while the remaining imaging elements 220 can be enabled.

As mounting bar 110 reaches even higher temperatures, e.g., >=140° F., the nineteen and twentieth imaging elements 220 of an exemplary imaging chip 220 can be disabled. The nineteen and twentieth imaging elements 220 of an exemplary imaging chip 220 can be disabled at higher temperatures, e.g., >=140° F., because at such temperatures nineteen and twentieth imaging elements 220 are pushed off of a designated print field. At >=140° F. and <150° F., the first, seventh and thirteen imaging elements 220 of an exemplary imaging chip 220 can be disabled while the remain imaging element 220 can be enabled.

As mounting bar 110 reaches yet even higher temperatures, e.g., >=150° F., the eighteen through twentieth imaging elements 220 of an exemplary imaging chip 220 can be disabled. The eighteen through twentieth imaging elements 220 can be disabled at higher temperatures, e.g., >=150° F., because at such temperatures the eighteen through twentieth imaging elements 220 are pushed off of a designated print field. At >=150° F., the sixth and twelfth imaging element 250 of the exemplary imaging chip 220 can be enabled while the remaining imaging elements 220 can be disabled.

Although lookup table 300 shows a temperature range between 90° F. and 150° F., lookup table 300 can represent any temperature range that can change the dpi of a full width imaging array 300. Although lookup table 300 shows a temperature increment of approximately 10° F., lookup table 300 can use any temperature increment that can change the dpi of a full width imaging array 200. Although lookup table 300 shows imaging elements 250 that can be enabled/disabled, lookup table 300 can enable/disable individual imaging elements 250 that can change the dpi of a full width imaging array 200. Although lookup table 200 is disclosed as corresponding to a rightmost imaging chip 220 on a full width imaging array 200, the principles disclosed herein apply to enabling/disabling of any imaging elements 250 on any of an imaging chip 220 that makes up a full width imaging array 200.

Figure 4:
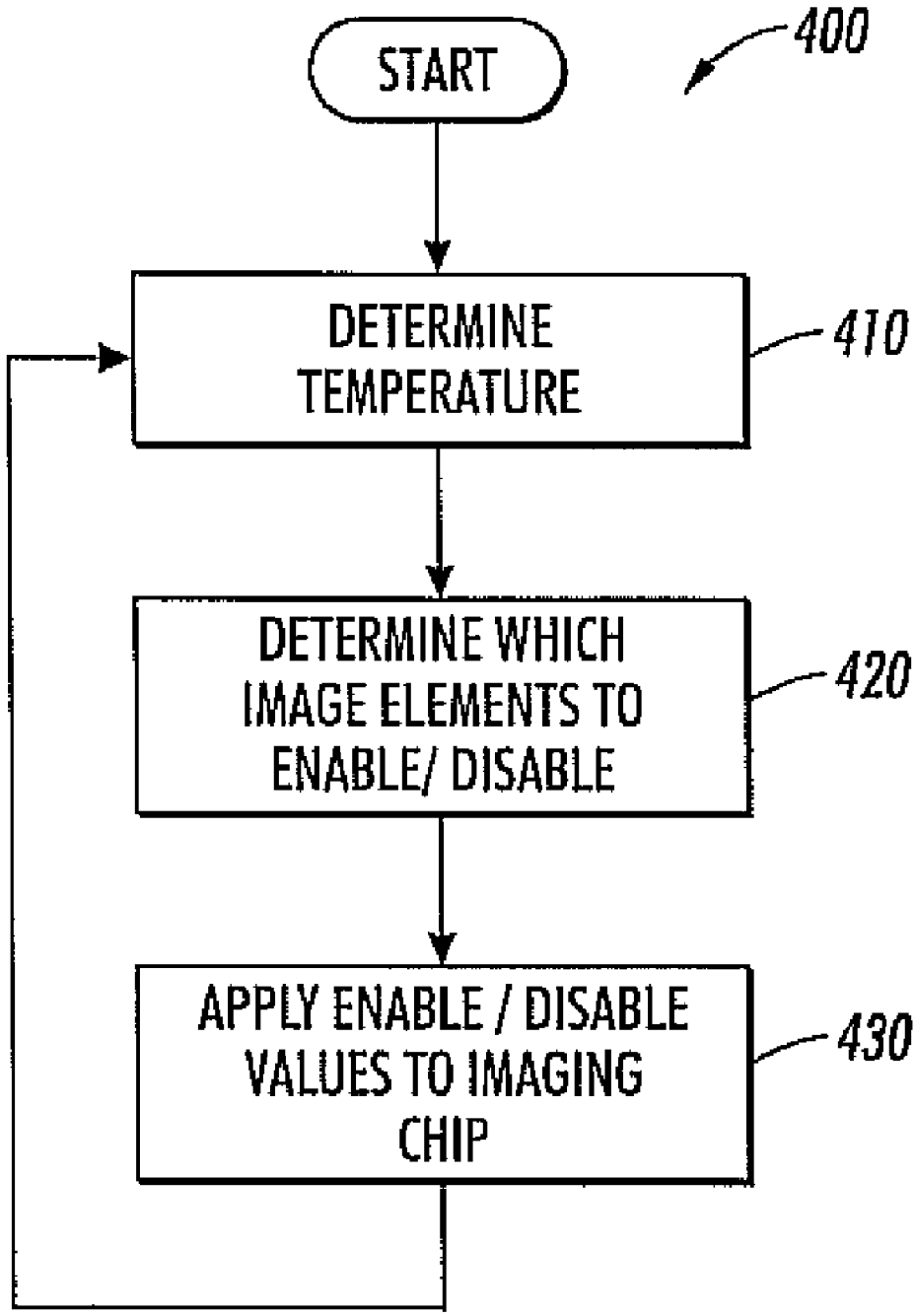
FIG. 4 shows a flow chart for enabling/disabling imaging elements, in accordance with the principles of the present teachings.

Although a lookup table 300 is shown to designate which imaging elements 250 to enable/disable on a full width imaging array 200 as a function of temperature, the principles disclosed herein apply to the use of any control that allows for enabling/disabling of imaging elements 250. For example, the principles disclosed herein to enable/disable imaging elements 250 as a function of temperature can be performed through an algorithm, a logic circuit, etc, FIG. 4 shows a flow chart 400 for enabling/disabling imaging elements 250, according to the principles of the present teachings. It should be readily apparent to those of ordinary skill in the art that the flow chart 400 shown in FIG. 4 represents a generalized flow chart and that other steps can be added or existing steps can be removed or modified while still remaining within the spirit and scope of the present teachings.

Step 410 can begin with control module 275 reading of a value from thermistor 240. The thermistor value can be used by the control module 275 to extrapolate a temperature of the mounting bar 110.

Step 420 can have control module 275 use the temperature as determined in step 410 to calculate lookup table 300 values. The control module 275 can populate the lookup table 300 with the calculated values.

Step 430 can have control module 275 use the lookup table 400 to enable and/or disable imaging elements 250. The process branches back to step 410 so that control module 275 can adjust which imaging elements 250 on an imaging chip 250 are enabled/disable based on a temperature of a mounting bar 110 at any given point in time. Alternately, the process can branch back to step 410 during a successive print and so that control module 275 can adjust which imaging elements 250 are enabled/disabled based on a temperature of a mounting bar 110.

The embodiments disclosed in accordance with the principles of the present teachings are shown for a full width imaging array 200 that uses LED technology. However, the principles disclosed herein apply to a full width imaging array 200 that relies on any technology that uses a plurality of imaging elements. For example, the principles disclosed herein can apply imaging elements 250 that include inkjet technology. As a temperature of a mounting bar 110 that includes an inkjet full width imaging array changes, inkjets on the full width imaging array 200 can be enabled/disabled.

Moreover, individual imaging elements from one or more of the individual full width imaging arrays from the plurality of full width imaging arrays that comprise a color printer, e.g., a black full width imaging array, a cyan full width imaging array, a magenta full width imaging array and a yellow full width imaging array, can be individually controlled to be, for example, enabled and/or disabled to maintain a uniform pattern to achieve a desired dpi.

The embodiments disclosed in accordance with the principles of the present teachings are shown for a full width imaging array 200 that uses LED technology. However, the principles disclosed herein apply to a full width imaging array that relies on any technology that uses a plurality of imaging elements 250. For example, the principles disclosed herein can apply to a full width imaging array that relies on image sensing technology, e.g., charge-coupled device (CCD), Compact Image Sensor (CID), etc. Such imaging sensing technology can be used in, e.g., a desktop scanner, photocopier, retinal scanner, fingerprint scanner, etc. Image sensing technology can include a one or more rows of sensor elements on a mounting bar. As a temperature of a mounting bar that includes the sensor elements changes, sensor elements on the full width imaging array can be enabled and disabled to maintain a desired dpi.

While the teachings disclosed herein has been illustrated with respect to one or more implementations, alterations and/or modifications can be made to the illustrated examples without departing from the spirit and scope of the appended claims. In addition, while a particular feature of the teachings disclosed herein may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising."

Other embodiments of the teachings disclosed herein will be apparent to those skilled in the art from consideration of the specification and practice of the teachings disclosed herein. It is intended that the specification and examples be considered as exemplary only, with a true scope and spirit of the teachings disclosed herein being indicated by the following claims.

What is claimed is:

1. A system for compensating for temperature changes, comprising:

a mounting bar;

a plurality of imaging chips configured for image forming at a specified resolution and adaptively mounted on the mounting bar, each imaging chip comprising a plurality of imaging elements;

a temperature determiner to determine a temperature of the mounting bar; and a control module configured to selectively disable at least one imaging element while a plurality of active imaging elements remain active to compensate for changes in image forming resolution caused by thermal expansion of the mounting bar so as to maintain image forming by the plurality of active imaging elements at the specified resolution while the at least one imaging element is disabled based on the determined temperature of the mounting bar.

2. The system according to claim 1, wherein the plurality of imaging elements are print elements.

3. The system according to claim 1, wherein the plurality of imaging elements are light emitting diodes.

4. The system according to claim 1, wherein the plurality of imaging elements are scan elements.

5. The system according to claim 1, further comprising a lookup table to disable a plurality of imaging elements while the plurality of active imaging elements remain active to compensate for changes in image forming resolution caused by thermal expansion of the mounting bar so as to maintain image forming at the specified resolution by the plurality of active imaging elements while the plurality of disabled imaging elements remain disabled.

6. The system according to claim 1, further comprising an algorithm to instruct the control module which of a plurality of imaging elements to disable while the plurality of active imaging elements remain active to compensate for changes in image forming resolution caused by thermal expansion of the mounting bar so as to maintain image forming at the specified resolution while the plurality of disabled imaging elements remain disabled.

7. The system according to claim 1, wherein the plurality of imaging elements are adaptively arranged on the mounting bar to create a full width array head.

8. The system according to claim 1, wherein the temperature determiner is comprised of at least one thermistor.

9. The system according to claim 1, wherein the control module is configured to disable a farthest outside imaging element on the imaging chip when the temperature is greater than a predetermined threshold while the plurality of active imaging elements remain active so as to maintain imaging forming by the active imaging elements while the farthest outside imaging element on the imaging chip is disabled.

10. A method of compensating for temperature changes, comprising:

providing a mounting bar;

providing a plurality of imaging chips configured for image forming at a specified resolution and adaptively mounted on the mounting bar, each imaging chip comprising a plurality of imaging elements;

determining at least one temperature of the mounting bar;

compensating for thermal expansion of the mounting bar by disabling at least one imaging element based on the determined temperature of the mounting bar; and forming an image at the specified resolution with a plurality of active imaging elements while the at least one imaging element remains disabled.

11. The method of claim 10, further comprising:

looking up in a lookup table to disable a plurality of imaging elements; and forming an image at the specified resolution with the plurality of active imaging elements while the plurality of disabled imaging elements remain disabled.

12. The method of claim 10, wherein the plurality of imaging elements are print elements.

13. The method of claim 10, wherein the plurality of imaging elements are light emitting diodes.

14. The method of claim 10, wherein the plurality of imaging elements are scan elements.

15. The method of claim 10, further comprising:

disabling a farthest outside imaging element when a temperature is greater than a predetermined threshold; and forming an image at the specified resolution with the plurality of active imaging elements while the farthest outside imaging element remains disabled.

16. A system for compensating for temperature changes, comprising:

a mounting bar;

a single imaging chip configured for image forming at a specified resolution and adaptively mounted on the mounting bar, the single imaging chip comprising a plurality of imaging elements;

a temperature determiner to determine a temperature of the mounting bar; and a control module configured to selectively disable at least one imaging element while a plurality of active imaging elements remain active to compensate for changes in image forming resolution caused by thermal expansion of the mounting bar so as to maintain image forming by the plurality of active imaging elements at the specified resolution while the at least one imaging element is disabled based on the determined temperature of the mounting bar.

17. The system of claim 16, wherein the single imaging chip comprises an organic light emitting diode.

18. The system of claim 1, wherein:

the system comprises a target first print resolution;

the plurality of imaging elements comprises a second print resolution which is different than the first target print resolution resulting from a temperature increase in the mounting bar; and the control module is configured to disable the at least one imaging element to maintain printing at the target first print resolution using the plurality of imaging elements having the second print resolution based on the determined temperature of the mounting bar.

19. The method of claim 10, further comprising:

the system comprises a target first print resolution;

the plurality of imaging elements comprises the first print resolution when the mounting bar is at a first temperature;

heating the mounting bar to a second temperature which is higher than the first temperature so that the plurality of imaging elements comprises a second print resolution which is different than the first target print resolution;

disabling a plurality of imaging elements;

printing at the target first print resolution with the plurality of imaging elements having the second print resolution using the plurality of active imaging elements while the plurality of disabled imaging elements remain disabled;

cooling the mounting bar to the first temperature;

after cooling the mounting bar to the first temperature, activating the plurality of disabled imaging elements; and with the mounting bar at the first temperature, printing at the target first print resolution using the plurality of active imaging elements and the plurality of activated disabled imaging elements.

* * * * *